US006377165B1

(12) United States Patent
Yoshioka et al.

(10) Patent No.: US 6,377,165 B1
(45) Date of Patent: Apr. 23, 2002

(54) MAYDAY SYSTEM EQUIPMENT AND MAYDAY SYSTEM

(75) Inventors: Kenji Yoshioka, Yokohama; Yasutoshi Nakama, Ikoma, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/488,526

(22) Filed: Jan. 21, 2000

(30) Foreign Application Priority Data

Jan. 22, 1999 (JP) ..... 11-014128

(51) Int. Cl.[7] ..... B60Q 1/00

(52) U.S. Cl. ..... 340/425.5; 340/903; 340/990; 340/995; 342/357.06; 342/357.07; 342/357.1

(58) Field of Search ..... 340/425.5, 990, 340/903, 901, 995; 342/457, 357.01, 357.06, 357.07, 357.09, 357.1

(56) References Cited

U.S. PATENT DOCUMENTS 5,311,197 A * 5/1994 Sorden et al. ..... 342/457
5,334,974 A * 8/1994 Simms et al. ..... 340/990
5,504,482 A * 4/1996 Schreder ..... 340/995

FOREIGN PATENT DOCUMENTS

| | | |
|---|---|---|
| DE | 4003563 | 8/1990 |
| DE | 3604216 | 11/1994 |
| DE | 4421508 | 12/1994 |
| DE | 4425530 | 2/1995 |
| DE | 29646011 | 5/1997 |
| DE | 19700353 | 7/1998 |
| JP | 5-5626 | 1/1993 |
| JP | 5-20578 | 1/1993 |

* cited by examiner

*Primary Examiner*—Edward Lefkowitz
(74) *Attorney, Agent, or Firm*—Louis Woo

(57) ABSTRACT

The Mayday system equipment, installable on an automotive vehicle, is separated into a locator unit which produces vehicle locative information and a communicator unit which produces emergency report information including the vehicle locative information produced by the locator unit. Resultant emergency report information is transmitted to an emergency center. The data/signal transmission between the locator unit and the communicator unit is performed via a cable or by wireless.

26 Claims, 15 Drawing Sheets

MAYDAY SYSTEM EQUIPMENT AND MAYDAY SYSTEM

BACKGROUND OF THE INVENTION

The present invention relates to a Mayday system including a Mayday equipment (i.e., communication terminal) mounted on a vehicle, such as an automotive vehicle. In case of emergency (e.g., traffic accident, emergent illness, etc), the Mayday system allows a user to contact with an emergency center, such as a police office, a fire station, a hospital, etc, which administrates this emergency system.

SUMMARY OF THE INVENTION

An object of the present invention is to provide a Mayday system equipment which functions in various ways, brings excellent usability and reliability, and also is advantageous in space utility.

In order to accomplish this and other related objects, the present invention provides a Mayday system equipment installable on an automotive vehicle. The Mayday system equipment of the present invention comprises a locator unit for producing vehicle locative information, and a communicator unit for producing emergency report information including the vehicle locative information produced by the locator unit and for transmitting the emergency report information to an emergency center. The locator unit and the communicator unit are separately or detachably arranged.

According to this arrangement, the locator unit and the communicator unit are arranged as independent units. Thus, if the automotive vehicle is already equipped with a car navigation system, it becomes possible to use the car navigation system as the locator unit.

Data/signal transmission between the locator unit and the communicator unit is performed via a cable or by wireless.

It is preferable that the locator unit may include a GPS (i.e., Global Positioning System) receiver which performs communications with a satellite to obtain GPS information representing the present position of the automotive vehicle, a gyro sensor which produces angular information representing the traveling direction of the automotive vehicle, and a distance information analyzer which obtains distance information representing a traveling distance of the automotive vehicle. A differential GPS analyzer may be used to correct an error involved in the information obtained from the satellite based on differential data. Thus, it becomes possible to obtain accurate vehicle locative information.

Meanwhile, it is preferable that the communicator unit includes the means for performing emergency report processing in response to a signal of a Mayday signal generating means (e.g., a Mayday button), and a hands-free system which allows a user to communicate with the emergency center without using a handset. This arrangement brings excellent usability of the Mayday system equipment.

Furthermore, it is preferable that the communicator unit includes an air bag analyzer for detecting activation of an air bag, a memory for storing the data obtained by the air bag analyzer, and means for performing emergency report processing in response to a signal of the air bag analyzer when the air bag is activated. Thus, in case of traffic accident, activation of the air bag can be immediately and automatically reported to the emergency center. Meanwhile, the communicator unit allows a rescue worker or anyone else to output the data stored in the memory to check the activation of the air bag.

Furthermore, it is preferable that the communicator unit includes a rolling sensor for detecting rolling of the automotive vehicle, a memory for storing the data obtained by the rolling sensor, and means for performing emergency report processing in response to a signal of the rolling sensor when the automotive vehicle has rolled. Thus, in case of traffic accident, rolling of the automotive vehicle can be immediately and automatically reported to the emergency center. Meanwhile, the communicator unit allows the rescue worker or anyone else to output the data stored in the memory to check the occurrence of the rolling of the automotive vehicle.

Furthermore, it is preferable that the communicator unit includes a temperature sensor for detecting abnormal temperature increase in the automotive vehicle, a memory for storing the data obtained by the temperature sensor, and means for performing emergency report processing in response to a signal of the temperature sensor when the temperature increases abnormally in the automotive vehicle. Thus, in case of traffic accident, an abnormal temperature increase of the automotive vehicle can be immediately and automatically reported to the emergency center. Meanwhile, the communicator unit allows the rescue worker or anyone else to output the data stored in the memory to check the occurrence of abnormal temperature increase in the automotive vehicle.

Furthermore, it is preferable that the communicator unit includes a collision analyzer for detecting collision of the automotive vehicle, a memory for storing the data obtained by the collision analyzer, and means for performing emergency report processing in response to a signal of the collision analyzer when the automotive vehicle is involved in a traffic accident. Thus, a collision of the automotive vehicle can be immediately and automatically reported to the emergency center. Meanwhile, the communicator unit allows the rescue worker or anyone else to output the data stored in the memory to check the occurrence of collision of the automotive vehicle.

Furthermore, it is preferable that the communicator unit includes a vehicle speed analyzer for detecting a traveling speed of the automotive vehicle, a memory for storing the data obtained by the vehicle speed analyzer, and means for performing emergency report processing to report the traveling condition of the automotive vehicle in an emergency situation. Thus, the traveling speed of the automotive vehicle can be immediately and automatically reported to the emergency center. Meanwhile, the communicator unit allows the rescue worker or anyone else to output the data stored in the memory to check the recorded traveling speed of the automotive vehicle.

Furthermore, it is preferable that the communicator unit includes a braking analyzer for detecting depression of a brake pedal of the automotive vehicle, a memory for storing the data obtained by the braking analyzer, and means for performing emergency report processing to report the traveling condition of the automotive vehicle in an emergency situation. Thus, the application of a braking force in the automotive vehicle can be immediately and automatically reported to the emergency center. Meanwhile, the communicator unit allows the rescue worker or anyone else to output the data stored in the memory to check the depression of the brake pedal of the automotive vehicle.

Furthermore, it is preferable that the communicator unit includes a reverse analyzer for detecting a reverse gear position of a transmission of the automotive vehicle, a memory for storing the data obtained by the reverse analyzer, and means for performing emergency report processing to report the traveling condition of the automotive vehicle in an emergency situation. Thus, the setting of the reverse gear position in the transmission of the automotive vehicle can be immediately and automatically reported to the emergency center. Meanwhile, the communicator unit allows the rescue worker or anyone else to output the data stored in the memory to check the traveling direction of the automotive vehicle.

Furthermore, it is preferable that the communicator unit includes a transmission analyzer for detecting a shift lever position or a gear position of a transmission of the automotive vehicle, a memory for storing the data obtained by the transmission analyzer, and means for performing emergency report processing to report the traveling condition of the automotive vehicle in an emergency situation. Thus, the shift lever position or the gear position of the transmission of the automotive vehicle can be immediately and automatically reported to the emergency center. Meanwhile, the communicator unit allows the rescue worker or anyone else to output the data stored in the memory to check the shift lever position or the gear position of the transmission of the automotive vehicle.

Furthermore, it is preferable that the communicator unit includes a yawing analyzer for detecting the yawing behavior of the automotive vehicle, a memory for storing the data obtained by the yawing analyzer, and means for performing emergency report processing to report the traveling condition of the automotive vehicle in an emergency situation. Thus, the yawing of the automotive vehicle can be immediately and automatically reported to the emergency center. Meanwhile, the communicator unit allows the rescue worker or anyone else to output the data stored in the memory to check the occurrence of yawing behavior of the automotive vehicle.

Moreover, another object of the present invention is to establish a Mayday system comprising the above-described Mayday system equipment installed on an automotive vehicle and an emergency center.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
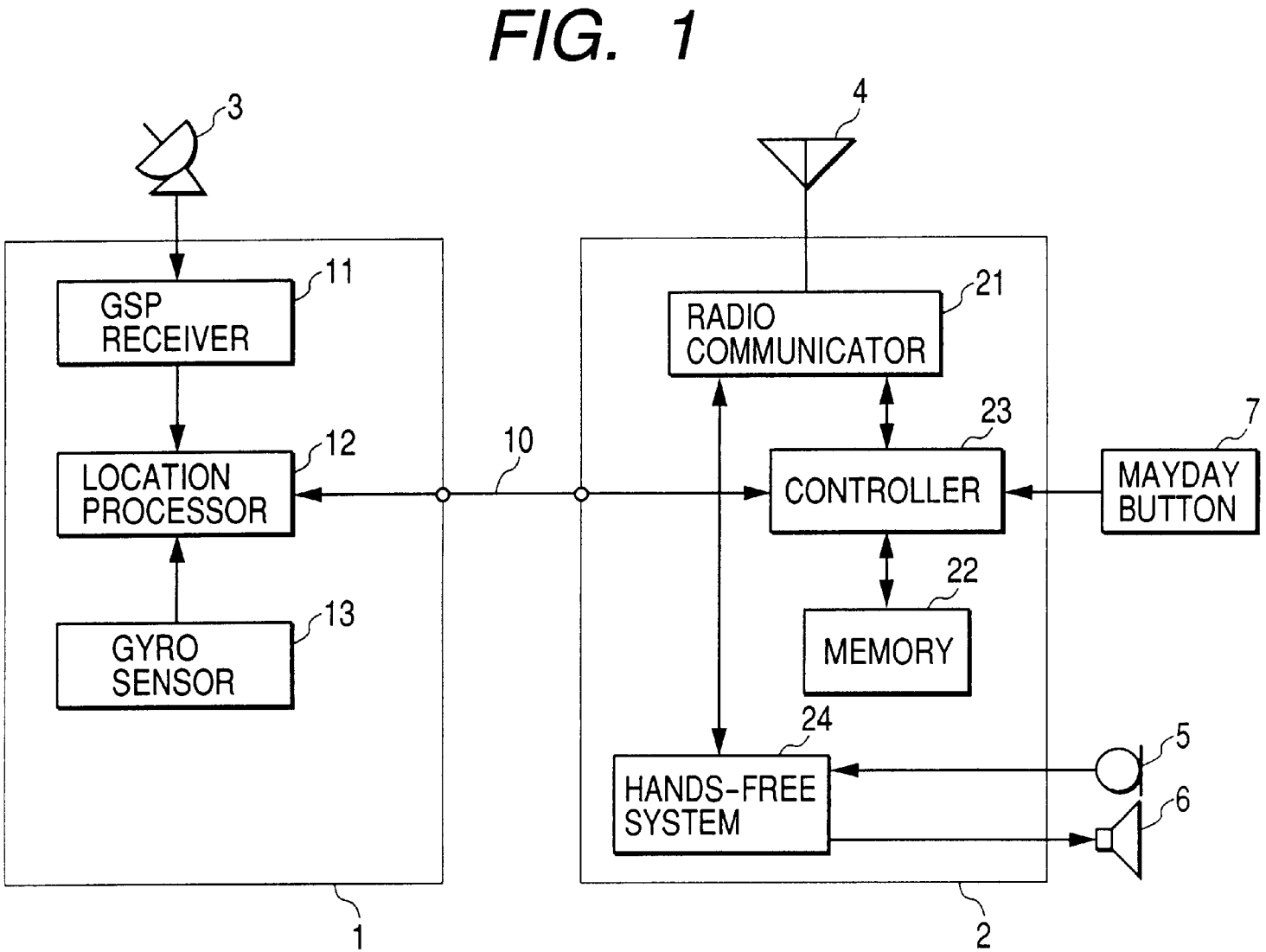
FIG. 1 is a circuit diagram showing the schematic arrangement of a Mayday system equipment in accordance with a first embodiment of the present invention.

Hereinafter, preferred embodiments of the present invention will be explained with reference to FIGS. 1 to 15. Identical parts are denoted by the same reference numerals throughout the views.

Mayday System

Figure 13:
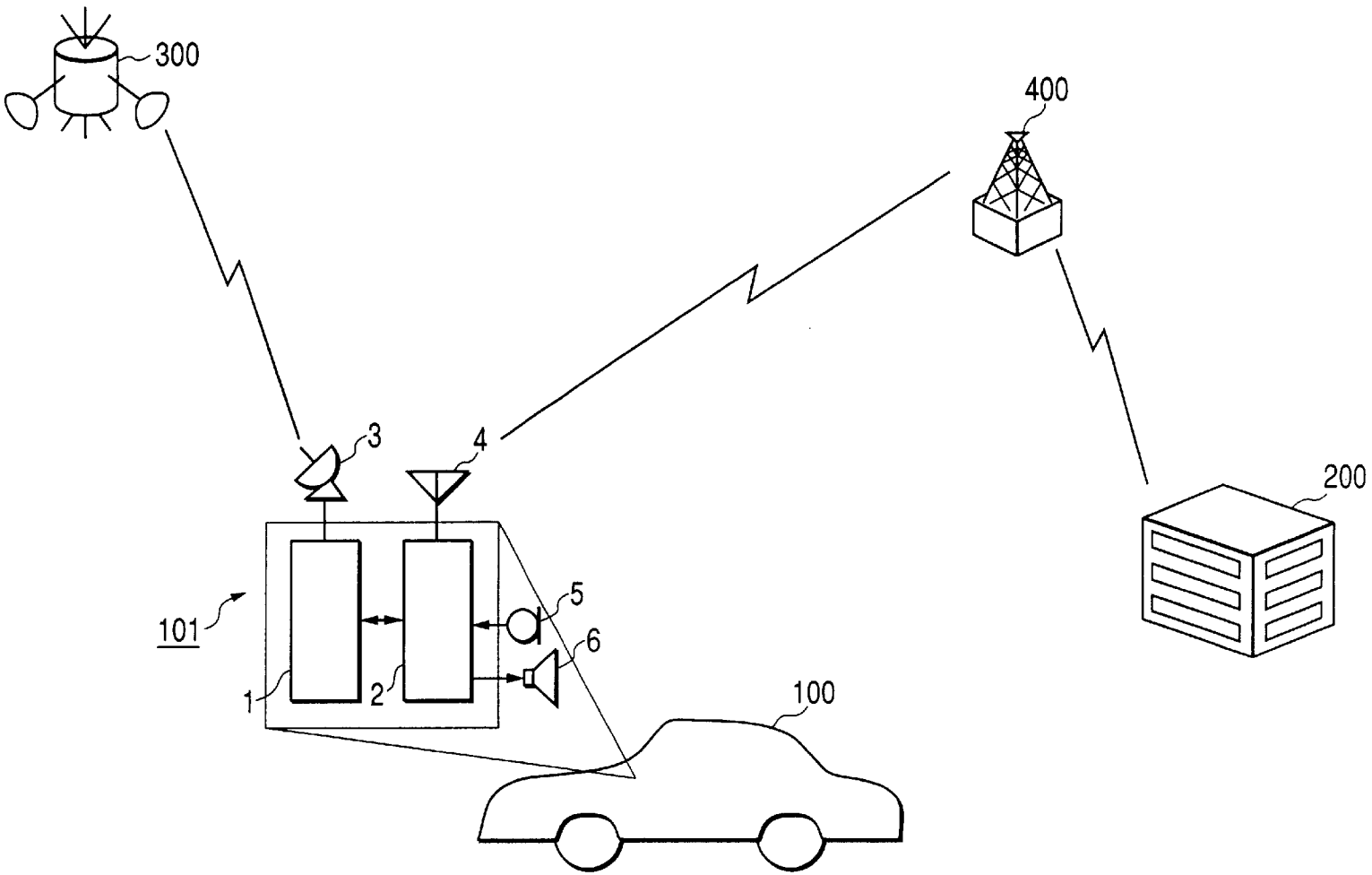
FIG. 13 is a view showing a Mayday system in accordance with the present invention.
Figure 14:
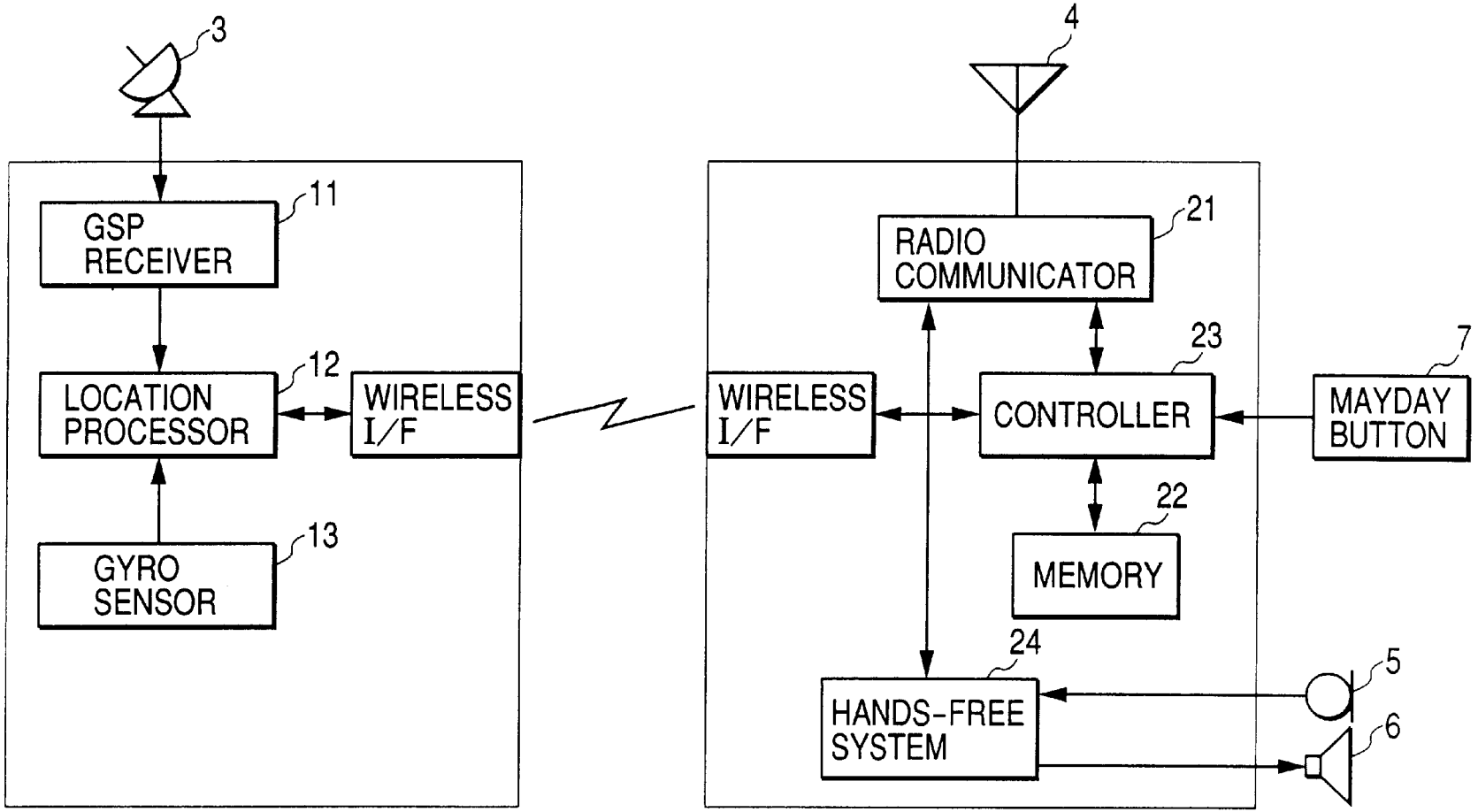
FIG. 14 is a circuit diagram showing the schematic arrangement of a modified Mayday system equipment in accordance with the first embodiment of the present invention, wherein the data/signal transmission is performed by wireless.

FIG. 13 shows a Mayday system of the present invention. A Mayday system equipment 101 is installed in an automotive vehicle 100. In case of emergency (e.g., traffic accident, emergent illness, etc.), the Mayday system equipment 101 informs the present vehicle position and vehicle identification data, such as a vehicle registration number, to an emergency center 200, such as a police office, a fire station, a hospital, etc., which administrates this emergency system.

First Embodiment

FIG. 1 is a circuit diagram showing the schematic arrangement of the Mayday system equipment in accordance with a first embodiment of the present invention.

The Mayday system equipment 101 includes a locator unit 1 and a communicator unit 2.

The locator unit 1 includes a GPS (i.e., Global Positioning System) receiver 11 equipped with a GPS antenna 3 which produces GPS information representing the present position of automotive vehicle 100 based on the communications with a satellite 300, and a gyro sensor 13 which produces angular information representing the traveling direction of the automotive vehicle 100. Furthermore, the locator unit 1 may receive vehicle speed information from a vehicle speed sensor which is conventionally equipped in the automotive vehicle 100.

A location processor 12 receives the GPS information from the GPS receiver 11, the angular information from the gyro sensor 13, and the vehicle speed information from the vehicle speed sensor. The location processor 12 calculates the present position and the driving direction of automotive vehicle 100 based on the collected data, and transmits the resultant vehicle locative information to the communicator unit 2. The communicator unit 2 is connected with the locator unit 1 via a connecting cable 10. In other words, the locator unit 1 and the communicator unit 2 are separately (or detachably) arranged.

The communicator unit 2 comprises a radio communicator 21 equipped with a communication antenna 4, a memory 22, a controller 23, and a hands-free system 24.

The radio communicator 21, such as a wireless telephone or a portable telephone, allows a user to perform voice/data communications with the emergency center 200 via a base station 400 of the communication common carrier.

The hands-free system 24, associated with a mike 5 and a speaker 6, allows the user to perform telephone conversation with the emergency center 200 without holding a handset.

The memory 22 stores important information, such as the telephone number of emergency center 200, the registered number of automotive vehicle 100, and the owner's name of automotive vehicle 100.

The controller 23 reads the telephone number of emergency center 200 from the memory 22 in response to an emergency signal caused by depression of a Mayday button 7, or the like. The user of automotive vehicle 100, a rescue worker or anyone else who is accessible to the Mayday system equipment 101 can depress the Mayday button 7 in case of emergence, such as traffic accident, emergent illness, etc. Meanwhile, the controller 23 receives the vehicle locative information from the location processor 12 of the locator unit 1.

Thus, in case of emergency, the controller 23 sends a dialing request signal to the radio communicator 21 together with the telephone number of the emergency center 200 read from the memory 22. In response to the dialing request signal, the radio communicator 21 places a phone call to the emergency center 200 via the base station 400. Then, the radio communicator 21 transmits the registered number of automotive vehicle 100 and the owner's name of automotive vehicle 100 read out of the memory 22 as well as the vehicle locative information obtained from the location processor 12 of the locator unit 1. Furthermore, the radio communicator 21 allows the user of automotive vehicle 100 or the rescue worker to talk with the members of emergency center 200 through the hands-free system 24 with the mike 5 and the speaker 6.

According to the above-described Mayday system, the user of automotive vehicle 100 or anyone else depresses the Mayday button 7 in case of emergency situation, such as traffic accident or emergent illness. The controller 23 receives the emergency signal caused by depression of the Mayday button 7. In response to the emergency signal, the controller 23 starts the emergency report processing. More specifically, the controller 23 of the communicator unit 2 sends an information request signal to the location processor 12 of the locator unit 1. In response to this information request signal, the location processor 12 collects the GPS information from the GPS receiver 11, the angular information from the gyro sensor 13, and optionally the vehicle speed information from the vehicle speed sensor. The location processor 12 calculates the present position and the traveling direction of automotive vehicle 100 based on the collected data, and transmits the resultant vehicle locative information to the controller 23 in the communicator unit 2.

The controller 23 of the communicator unit 2 receives the vehicle locative information transmitted from the locator unit 1.

Meanwhile, the controller reads the telephone number of emergency center 200 from the memory 22, and sends the dialing request signal to the radio communicator 21. With reference to the telephone number of the emergency center 200 read out of the memory 22, the radio communicator 21 with the communication antenna 4 places a phone call to the emergency center 200 via the base station 400. After a response signal is returned from the emergency center 200, the radio communicator 21 starts the voice/data communications with the emergency center 200. More specifically, the radio communicator 21 sends the controller 23 an authentication signal (representing the successful establishment of the radio communication route or channel).

In response to the authentication signal, the controller 23 controls the radio communicator 21 to perform the data communication for transmitting the registered number of automotive vehicle 100 and the owner's name of automotive vehicle 100 which are read out of the memory 22 as well as the vehicle locative information (including at least the present position of automotive vehicle 100) obtained from the location processor 12 of the locator unit 1. Thus, the emergency center 200 immediately receives the critical information required for taking an action in response to the received emergence call.

After accomplishing the data communication, the radio communicator 21 allows the user of automotive vehicle 100 or anyone else (e.g., a rescue worker) accessible to the Mayday system equipment 101 to talk with a personnel in the emergency center 200. More specifically, the voice signal transmitted from the emergency center 200 is received by the communication antenna 4 and sent to the hands-free system 24 via the radio communicator 21.

The hands-free system 24 performs the predetermined signal processing, such as the howling control and the echo cancel control, to reconstruct or refine the received voice signal. The received voice signal generated from the hands-free system 24 is input to the speaker 6 via a speaker amplifier. Thus, the speaker 6 outputs the voice of the personal of emergency center 200.

The mike 5 picks up or collects the voice of the user or anyone else existing by the Mayday system equipment 101 of the automotive vehicle 100. The mike 5 converts the collected voice into a transmit voice signal and sends this transmit voice signal to the hands-free system 24. The hands-free system 24 applied the above-described signal processing (e.g., the howling control and the echo cancel control) to the transmit voice signal. Then, the processed voice signal is transmitted from the radio communicator 21 to the emergency center 200.

As apparent from the foregoing description, the first embodiment of the present invention provides the Mayday system equipment 101 comprising the locator unit 1 which produces the vehicle locative information and the communicator unit 2 which produces the emergency report information including the vehicle locative information obtained by the locator unit 1. The locator unit 1 and the communicator unit 2 are connected by the connecting cable 10. Alternatively, the locator unit 1 and the communicator unit 2 are disconnected and the data/signal transmission between them can be performed by wireless.

In anyway, the locator unit 1 and the communicator unit 2 are separately arranged. The data/signal transmission between them is performed via cable or by wireless.

When a car navigation system is already installed on the automotive vehicle 100, the car navigation system is functionally equivalent to the locator unit 1 of the first embodiment. Thus, the Mayday system equipment 101 of the first embodiment can be constituted by combining the conventional navigation system with a wireless or portable telephone which is capable of functioning as the communicator unit 2 of the first embodiment.

Second Embodiment

Figure 2:
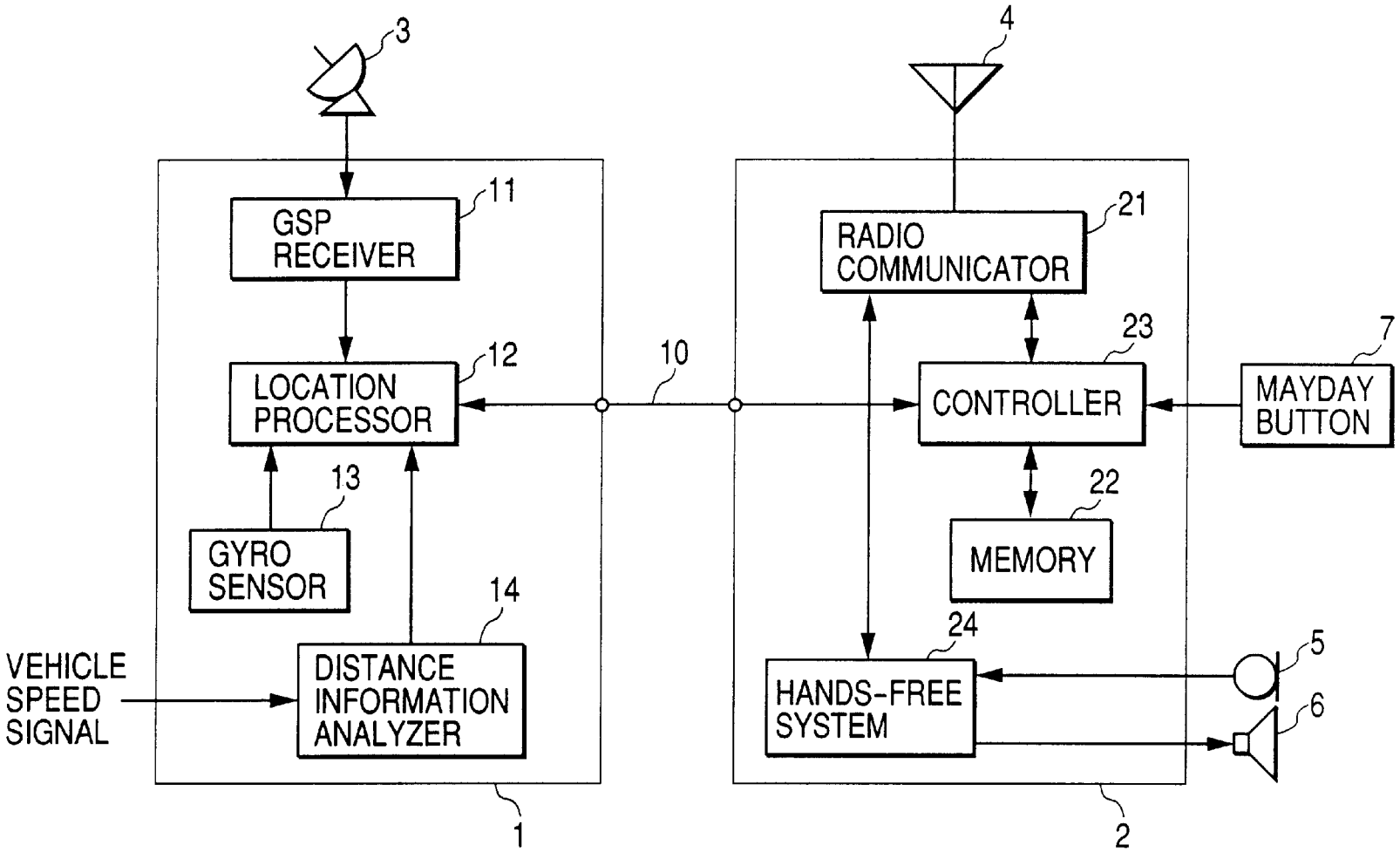
FIG. 2 is a circuit diagram showing the schematic arrangement of a Mayday system equipment in accordance with a second embodiment of the present invention.

FIG. 2 is a circuit diagram showing the schematic arrangement of the Mayday system equipment in accordance with a second embodiment of the present invention. The second embodiment differs from the first embodiment in that the locator unit 1 further includes a distance information analyzer 14. The distance information analyzer 14 inputs a vehicle speed signal (pulse signal) from the vehicle speed sensor which is conventionally equipped in the automotive vehicle 100, and outputs distance information obtained based on the vehicle speed signal.

The location processor 12 calculates the present position and the traveling direction of automotive vehicle 100 based on the GPS information obtained from the GPS receiver 11, and the angular information obtained from the gyro sensor 13, and also the distance information obtained from the distance information analyzer 14.

Accordingly, the second embodiment makes it possible to accurately obtain the vehicle locative information.

Third Embodiment

Figure 3:
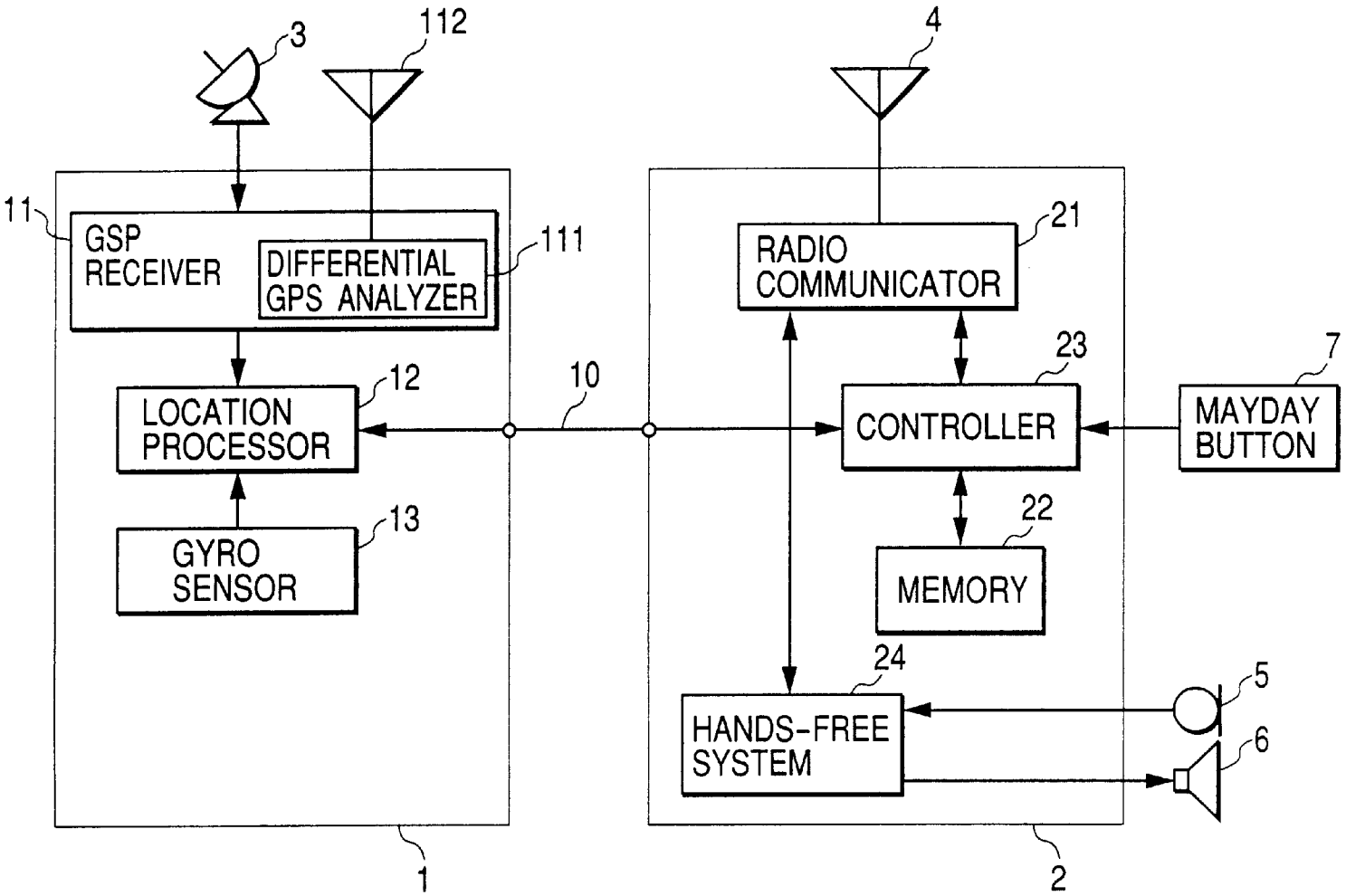
FIG. 3 is a circuit diagram showing the schematic arrangement of a Mayday system equipment in accordance with a third embodiment of the present invention.

FIG. 3 is a circuit diagram showing the schematic arrangement of the Mayday system equipment in accordance with a third embodiment of the present invention. The third embodiment differs from the first embodiment in that the GPS receiver 11 of the locator unit 1 includes a differential GPS analyzer 111 which is connected to an FM antenna 112.

The radio wave transmitted between the satellite and the GPS system of public welfare use generally includes an error component which always varies. The GPS receiver 11 has the differential GPS analyzer 111 for correcting this error. A plurality of D-GPS stations, each having correct locative information, are located nationwide. Each D-GPS station calculates the present error based on the received GPS signal. An FM broadcasting station airs the error correction data thus obtained by the D-GPS station. The differential GPS analyzer 111 in the GSP receiver 11 receives the error correction data through the FM antenna 112. The vehicle locative information obtained by the GPS receiver 11 is therefore corrected by the error correction data obtained by the differential GPS analyzer 111.

Accordingly, the third embodiment makes it possible to accurately obtain the vehicle locative information.

Fourth Embodiment

Figure 4:
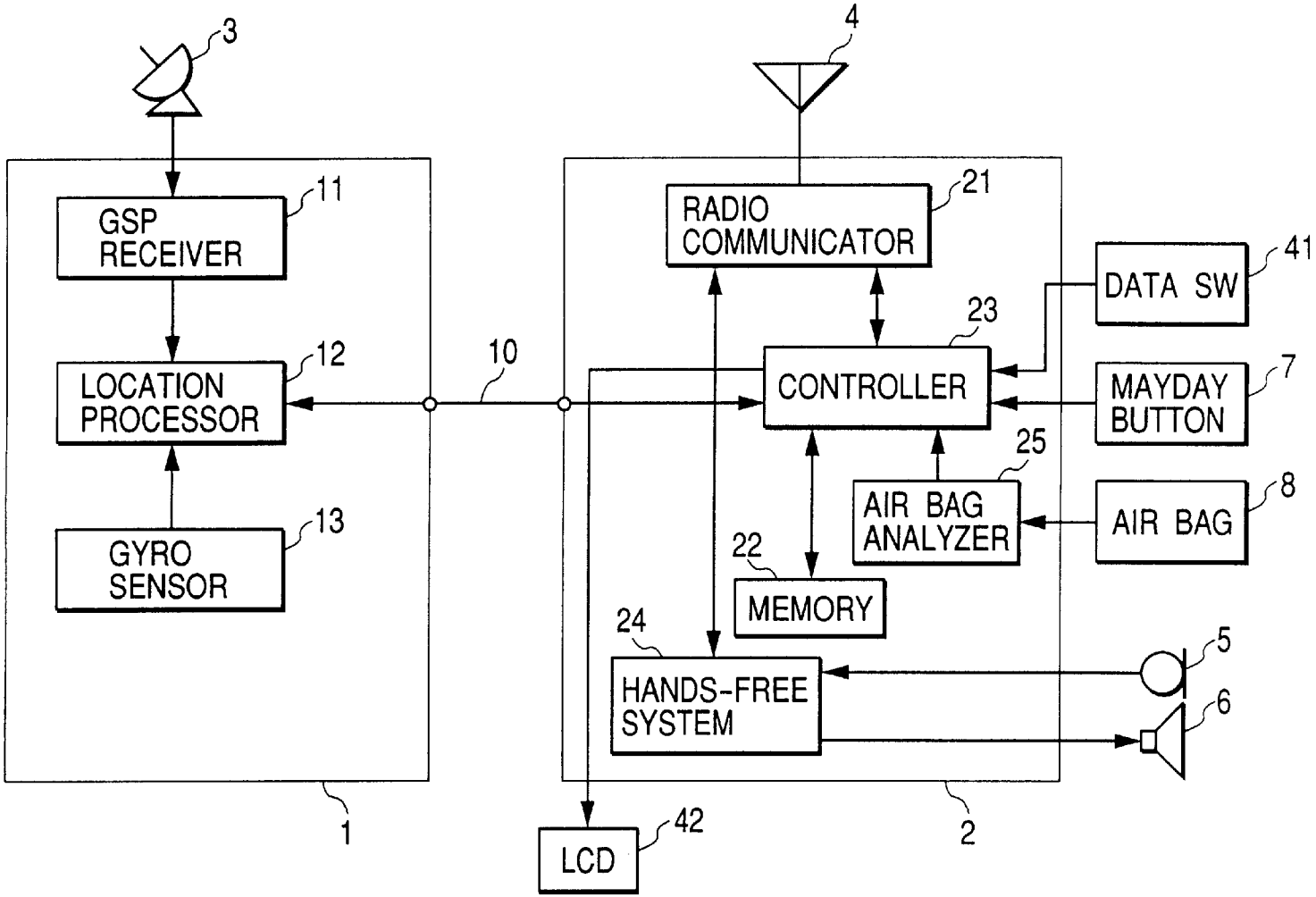
FIG. 4 is a circuit diagram showing the schematic arrangement of a Mayday system equipment in accordance with a fourth embodiment of the present invention.

FIG. 4 is a circuit diagram showing the schematic arrangement of the Mayday system equipment in accordance with a fourth embodiment of the present invention. The fourth embodiment differs from the first embodiment in that the communicator unit 2 further comprises an air bag analyzer 25 which is connected to an air bag 8.

The air bag analyzer 25 is responsive to the activation of the air bag 8, and generates an emergency report request signal in response to the activation of the air bag 8. The controller 23 receives the emergency report request signal sent from the air bag analyzer 25. The memory 22 stores the date/time of the activation of the air bag 8. The controller 23 controls the radio communicator 21 to perform the emergency report processing.

In this case, the controller 23 produces the emergency report information including a code number specifying the activation of the air bag 8. The radio communicator 21 transmits the designated code number to the emergency center 200. Thus, the personnel in the emergency center 200 can promptly grasp the aspect of the traffic accident including the activation of air bag 8.

Meanwhile, the fourth embodiment allows the rescue worker or anyone else arriving at the site of traffic accident to output the data retroactively stored in the memory 22 to check the accurate date/time of the activation of air bag 8. The communicator unit 2 is equipped with a data switch 41. When the data switch 41 is depressed by the rescue worker or anyone else, the controller 23 reads the data from the memory 22 and displays the readout data on a LCD (liquid crystal display) unit 42. When the LCD unit of the car navigation system is available, it is possible to output the data to the car navigation system instead of using the LCD unit 42 of communicator unit 2.

Fifth Embodiment

Figure 5:
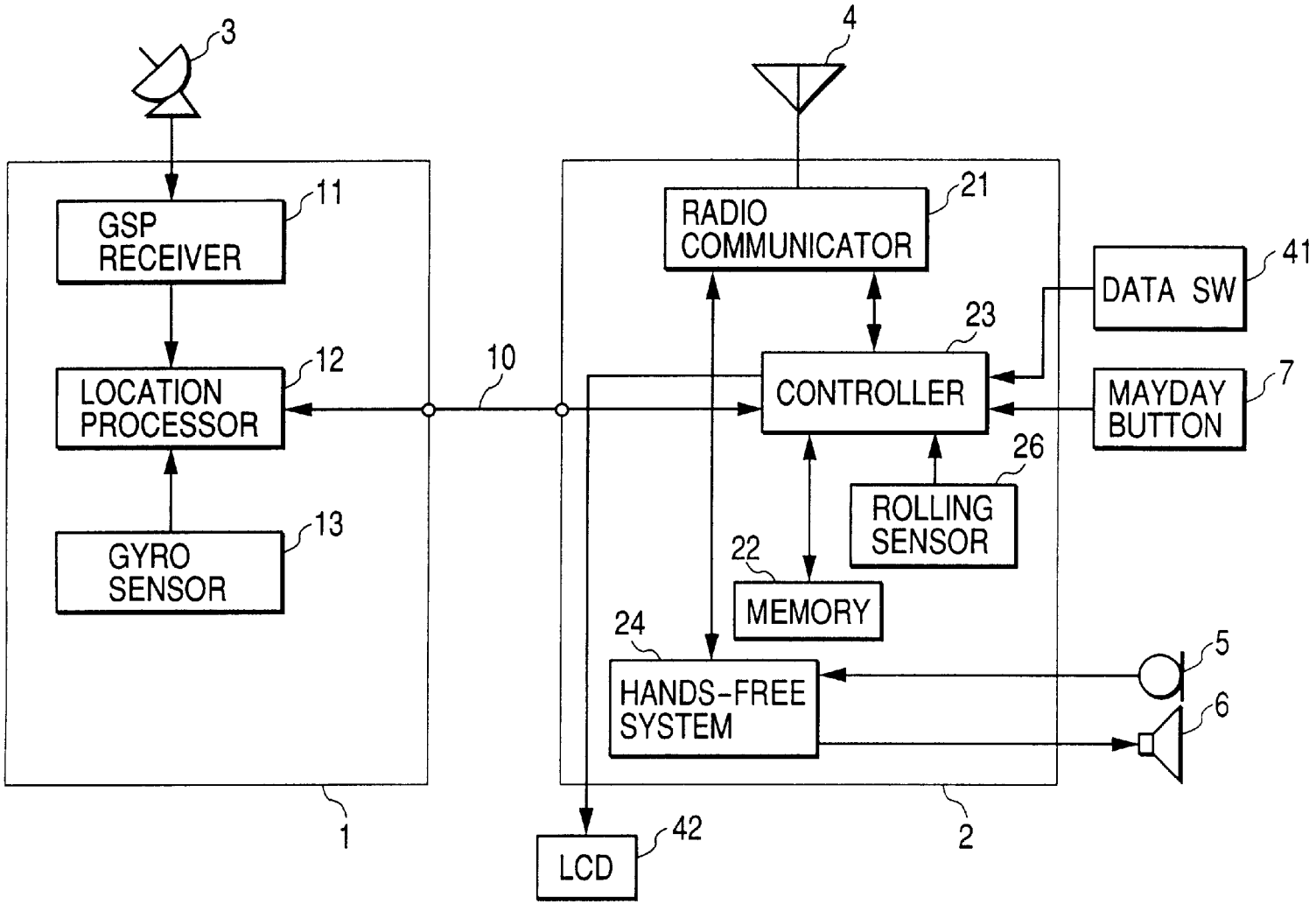
FIG. 5 is a circuit diagram showing the schematic arrangement of a Mayday system equipment in accordance with a fifth embodiment of the present invention.

FIG. 5 is a circuit diagram showing the schematic arrangement of the Mayday system equipment in accordance with a fifth embodiment of the present invention. The fifth embodiment differs from the first embodiment in that the communicator unit 2 further comprises a rolling sensor 26.

The rolling sensor 26 detects the rolling of automotive vehicle 100 which is involved in a traffic accident. The rolling sensor 26 generates the emergency report request signal in response to the rolling of the automotive vehicle 100. The controller 23 receives the emergency report request signal sent from the rolling sensor 26. The memory 22 stores the date/time of the detected rolling of automotive vehicle 100. The controller 23 controls the radio communicator 21 to perform the emergency report processing.

In this case, the controller 23 produces the emergency report information including a code number specifying the rolling of the automotive vehicle 100. The radio communicator 21 transmits the designated code number to the emergency center 200. Thus, the personnel in the emergency center 200 can promptly grasp the aspect of the traffic accident including the occurrence of rolling of automotive vehicle 100.

Meanwhile, the fifth embodiment allows the rescue worker or anyone else arriving at the site of traffic accident to output the data retroactively stored in the memory 22 to check the accurate date/time of the rolling of automotive vehicle 100. When the data switch 41 is depressed by the rescue worker or anyone else, the controller 23 reads the data from the memory 22 and displays the readout data on the LCD unit 42.

Sixth Embodiment

Figure 6:
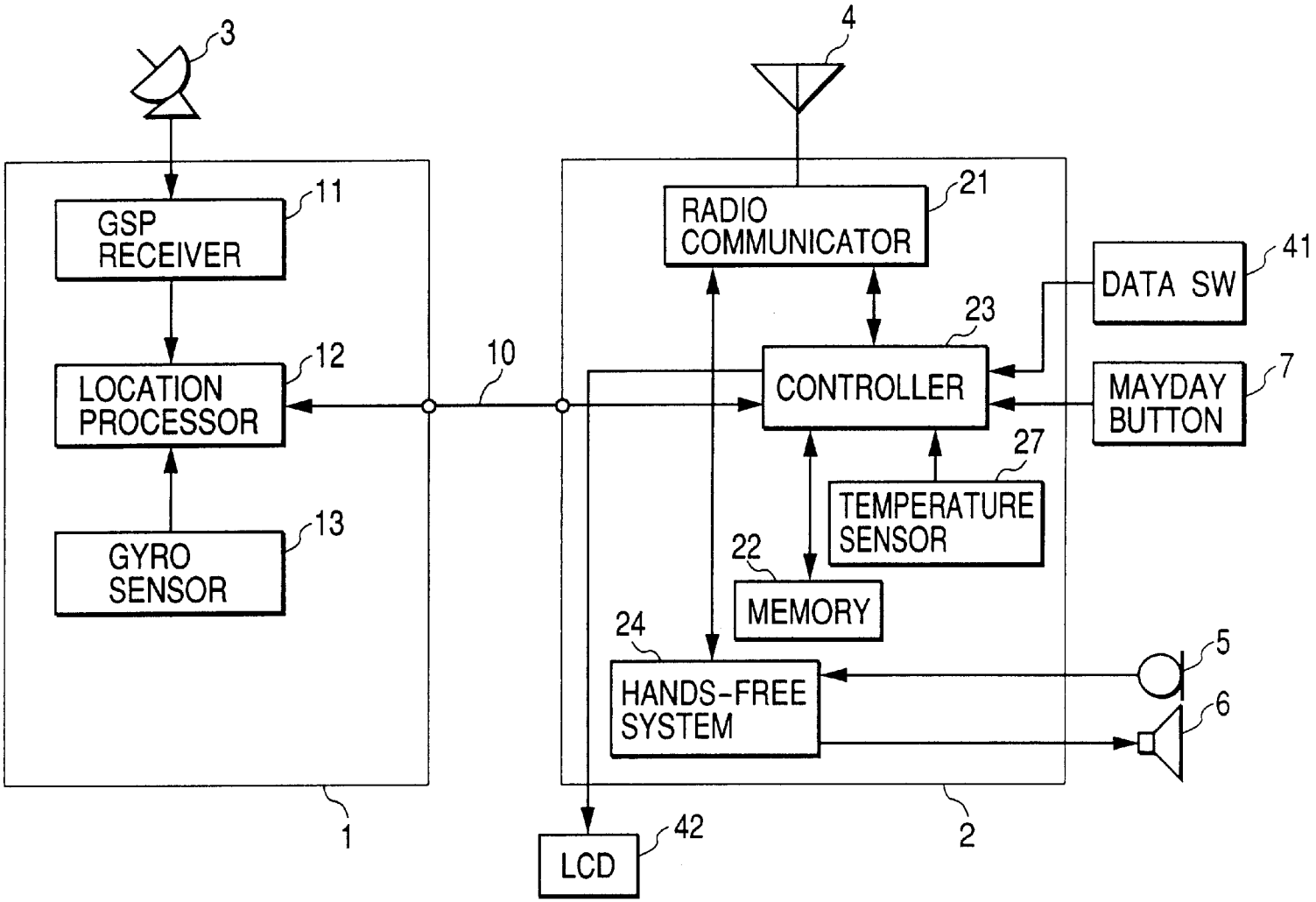
FIG. 6 is a circuit diagram showing the schematic arrangement of a Mayday system equipment in accordance with a sixth embodiment of the present invention.

FIG. 6 is a circuit diagram showing the schematic arrangement of the Mayday system equipment in accordance with a sixth embodiment of the present invention. The sixth embodiment differs from the first embodiment in that the communicator unit 2 further comprises a temperature sensor 27.

The temperature sensor 27 detects abnormal temperature increase in the passenger compartment of the automotive vehicle 100. For example, the car fire will cause such abnormal temperature increase in the automotive vehicle 100. The temperature sensor 27 generates the emergency report request signal in response to the abnormal temperature increase in the automotive vehicle 100.

The controller 23 receives the emergency report request signal sent from the temperature sensor 27. The memory 22 stores the date/time of the abnormal temperature increase detected in the automotive vehicle 100. The controller 23 controls the radio communicator 21 to perform the emergency report processing.

In this case, the controller 23 produces the emergency report information including a code number specifying the abnormal temperature increase in the automotive vehicle 100. The radio communicator 21 transmits the designated code number to the emergency center 200. Thus, the personnel in the emergency center 200 can promptly grasp the aspect of the traffic accident including the occurrence of car fire.

Meanwhile, the sixth embodiment allows the rescue worker or anyone else arriving at the site of traffic accident to output the data retroactively stored in the memory 22 to check the accurate date/time of the car fire of automotive vehicle 100. When the data switch 41 is depressed by the rescue worker or anyone else, the controller 23 reads the data from the memory 22 and displays the readout data on the LCD unit 42.

Namely, the sixth embodiment provides a Mayday system equipment comprising the communicator unit (2) including a temperature sensor (27) for detecting abnormal temperature increase in the automotive vehicle (100), a memory (22) for storing the data obtained by the temperature sensor (27), and means (21, 22, 23) for performing emergency report processing in response to a signal of the temperature sensor (27) when the temperature increases abnormally in the automotive vehicle (100). The information transmitted to the emergency center (200) through the emergency report processing includes the abnormal temperature increase in the automotive vehicle (100). The communicator unit (2) outputs the data stored in the memory (22) in response to a request signal to check the occurrence of abnormal temperature increase in the automotive vehicle (100).

Seventh Embodiment

Figure 7:
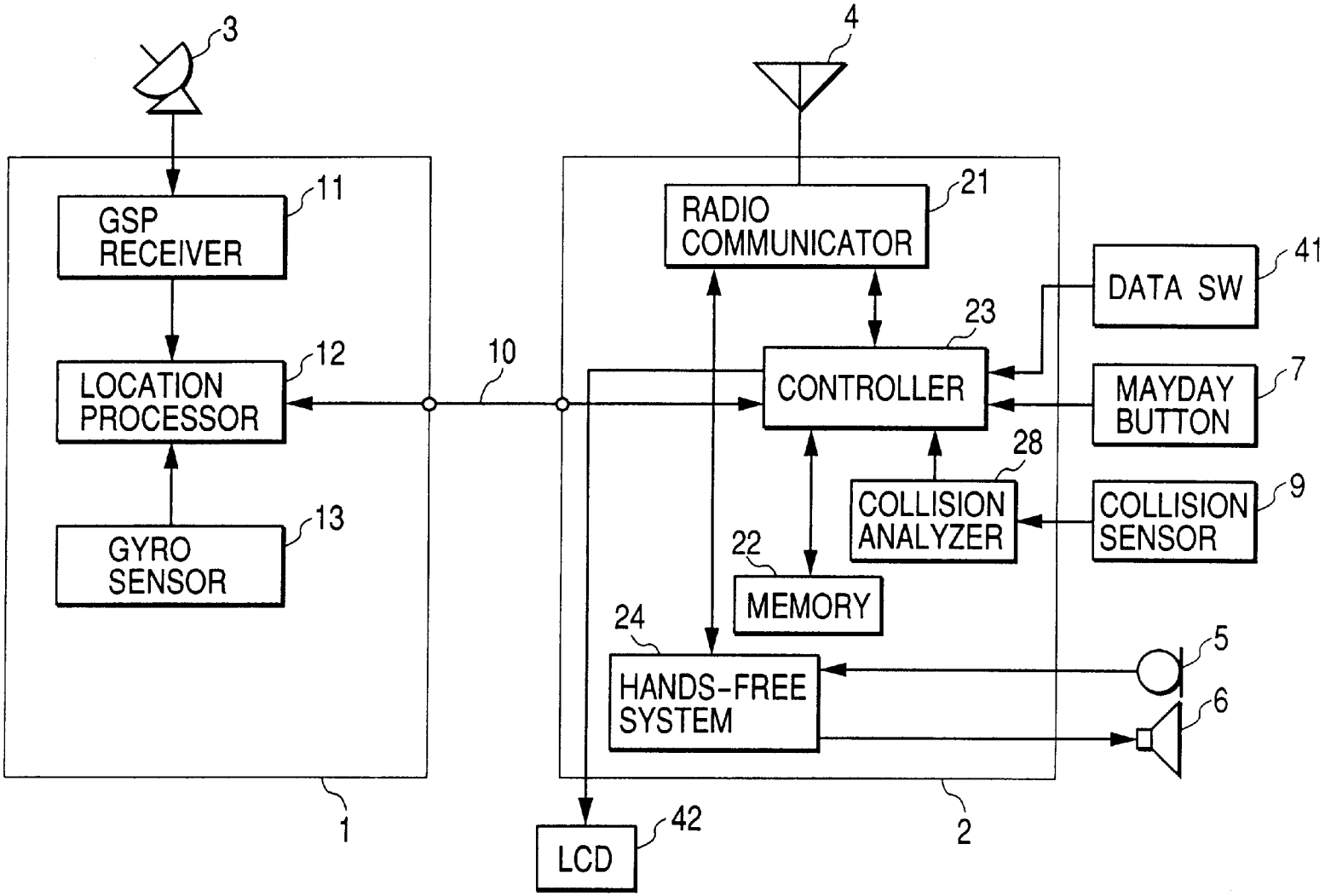
FIG. 7 is a circuit diagram showing the schematic arrangement of a Mayday system equipment in accordance with a seventh embodiment of the present invention.

FIG. 7 is a circuit diagram showing the schematic arrangement of the Mayday system equipment in accordance with a seventh embodiment of the present invention. The seventh embodiment differs from the first embodiment in that the communicator unit 2 further comprises a collision analyzer 28 connected to a collision sensor 9.

The collision sensor 9 is responsive to a predetermined heavy load acting thereon in case of car crash. For example, such a heavy load acts on the collide sensor 9 when the automotive vehicle 100 collides with other vehicle or a guard rail. The collision analyzer 28 generates the emergency report request signal in response to the signal of collision sensor 9. The controller 23 receives the emergency report request signal sent from the collision analyzer 28. The memory 22 stores the date/time of the collision. The controller 23 controls the radio communicator 21 to perform the emergency report processing.

In this case, the controller 23 produces the emergency report information including a code number specifying the operation of the collision sensor 9. The radio communicator 21 transmits the designated code number to the emergency center 200. Thus, the personnel in the emergency center 200 can promptly grasp the aspect of the traffic accident including the occurrence of car crash.

Meanwhile, the seventh embodiment allows the rescue worker or anyone else arriving at the site of traffic accident to output the data retroactively stored in the memory 22 to check the accurate date/time of the collision of automotive vehicle 100. When the data switch 41 is depressed by the rescue worker or anyone else, the controller 23 reads the data from the memory 22 and displays the readout data on the LCD unit 42.

Eighth Embodiment

Figure 8:
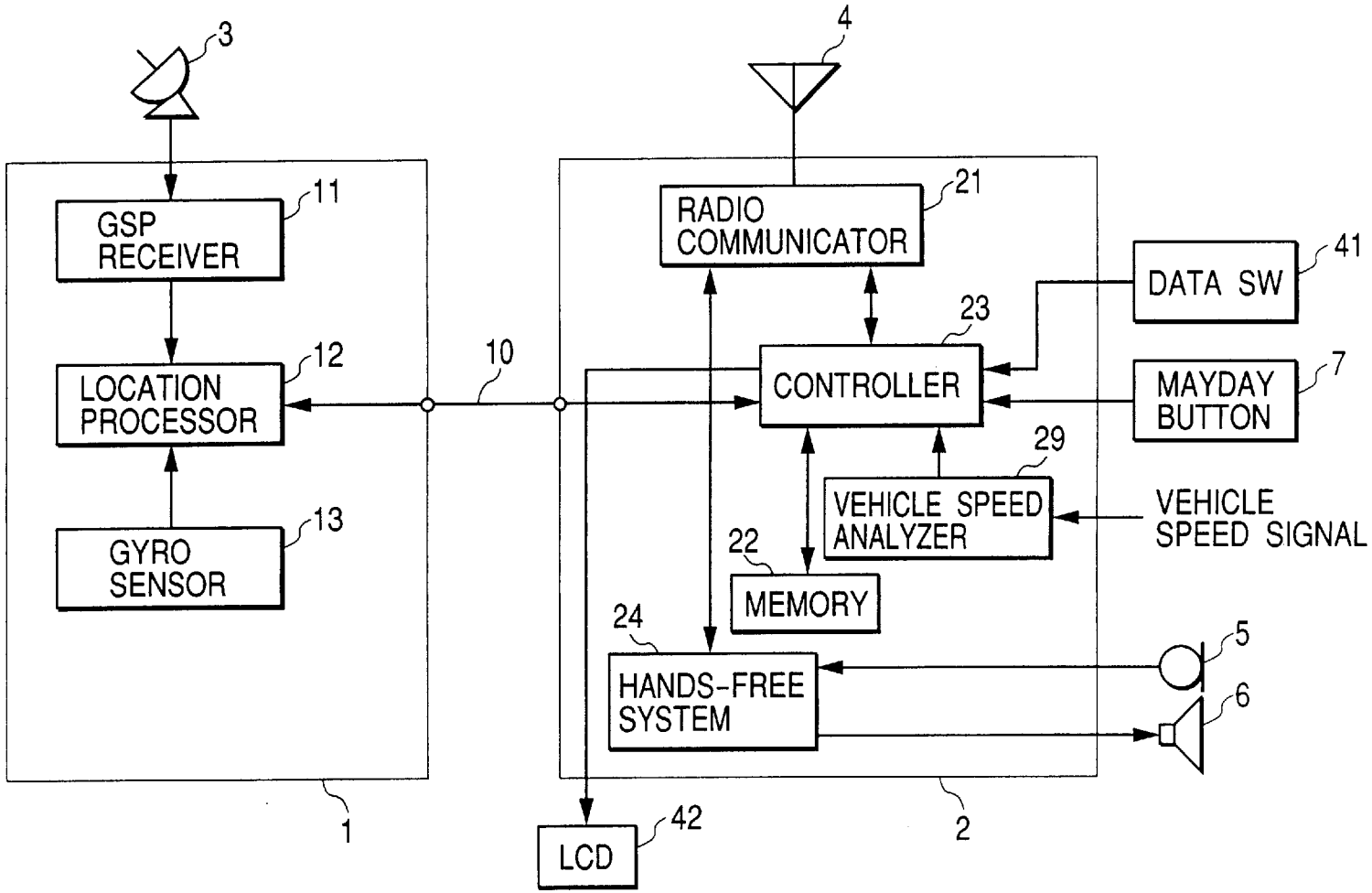
FIG. 8 is a circuit diagram showing the schematic arrangement of a Mayday system equipment in accordance with an eighth embodiment of the present invention.

FIG. 8 is a circuit diagram showing the schematic arrangement of the Mayday system equipment in accordance with an eighth embodiment of the present invention. The eighth embodiment differs from the first embodiment in that the communicator unit 2 further comprises a vehicle speed analyzer 29. The vehicle speed analyzer 29 inputs the vehicle speed signal (pulse signal) from the vehicle speed sensor equipped in the automotive vehicle 100, and outputs vehicle speed information obtained based on the vehicle speed signal.

The controller 23 causes the memory 22 to store the vehicle speed information obtained during a predetermined past time (which is arbitrarily determined). When the radio communicator 21 performs the emergency report processing in response to the traffic accident or the like, the controller 23 generates the emergency report information including the vehicle speed information stored in the memory 22. The radio communicator 21 transmits the vehicle speed information to the emergency center 200. Thus, the personnel in the emergency center 200 can promptly grasp the aspect of the traffic accident including the critical traveling speed of automotive vehicle 100.

Meanwhile, the eighth embodiment allows the rescue worker or anyone else arriving at the site of traffic accident to output the data retroactively stored in the memory 22 to check the accurate traveling speed of automotive vehicle 100 at the time the automotive vehicle 100 was involved in the traffic accident. When the data switch 41 is depressed by the rescue worker or anyone else, the controller 23 reads the data from the memory 22 and displays the readout data on the LCD unit 42.

Ninth Embodiment

Figure 9:
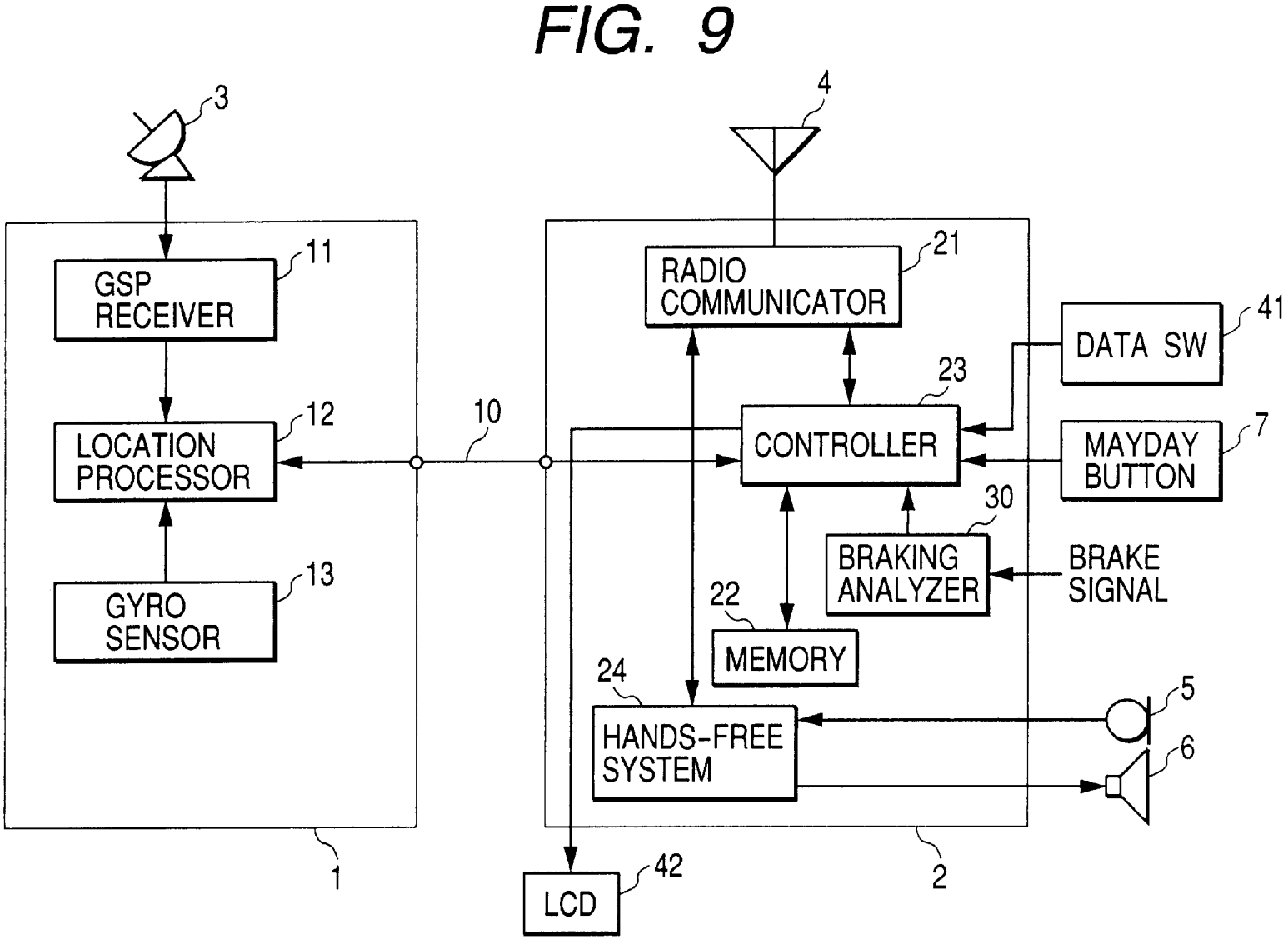
FIG. 9 is a circuit diagram showing the schematic arrangement of a Mayday system equipment in accordance with a ninth embodiment of the present invention.

FIG. 9 is a circuit diagram showing the schematic arrangement of the Mayday system equipment in accordance with a ninth embodiment of the present invention. The ninth embodiment differs from the first embodiment in that the communicator unit 2 further comprises a braking analyzer 30. The braking analyzer 30 inputs the brake signal from a brake sensor which is conventionally equipped in the automotive vehicle 100 to detect the depression of the brake pedal. The braking analyzer 30 outputs braking information based on the brake signal.

The controller 23 causes the memory 22 to store the braking information thus obtained during a predetermined past time (which is arbitrarily determined). When the radio communicator 21 performs the emergency report processing in response to the traffic accident or the like, the controller 23 generates the emergency report information including the braking information stored in the memory 22. The radio communicator 21 transmits the braking information to the emergency center 200. Thus, the personnel in the emergency center 200 can promptly grasp the aspect of the traffic accident including the properness in the application of braking force.

Meanwhile, the ninth embodiment allows the rescue worker or anyone else arriving at the site of traffic accident to output the data retroactively stored in the memory 22 to check whether the brake pedal was depressed at the time the automotive vehicle 100 was involved in the traffic accident. When the data switch 41 is depressed by the rescue worker or anyone else, the controller 23 reads the data from the memory 22 and displays the readout data on the LCD unit 42.

Namely, the ninth embodiment provides a Mayday system equipment comprising the communicator unit (2) including a braking analyzer (30) for detecting depression of a brake pedal of the automotive vehicle (100), a memory (22) for storing the data obtained by the braking analyzer (30), and means (21, 22, 23) for performing emergency report processing to report the braking condition in an emergency situation. The information transmitted to the emergency center (200) through the emergency report processing includes the depression of the brake pedal of the automotive vehicle (100). The communicator unit (2) outputs the data stored in the memory (22) in response to a request signal to check the depression of the brake pedal of the automotive vehicle (100).

Tenth Embodiment

Figure 10:
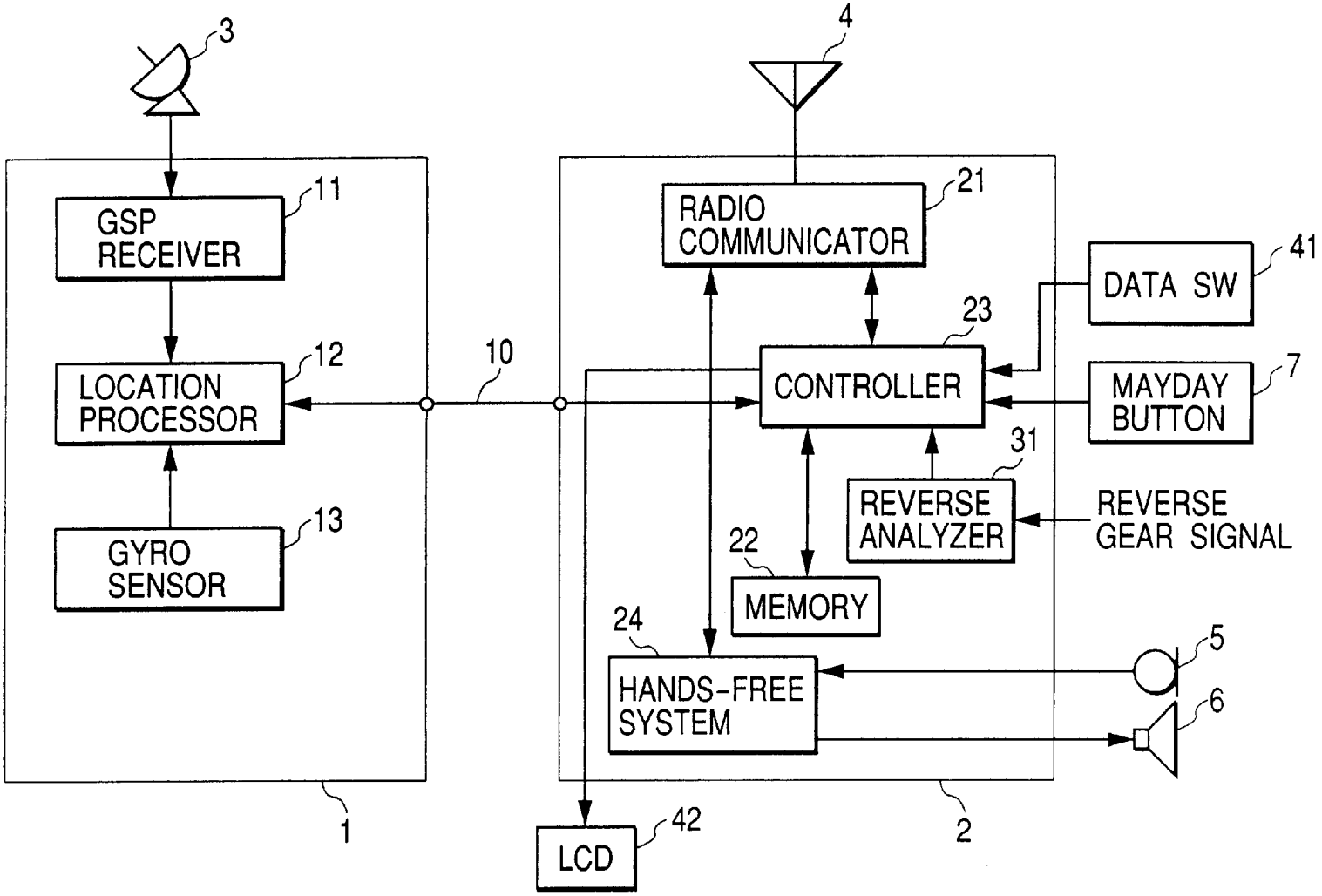
FIG. 10 is a circuit diagram showing the schematic arrangement of a Mayday system equipment in accordance with a tenth embodiment of the present invention.

FIG. 10 is a circuit diagram showing the schematic arrangement of the Mayday system equipment in accordance with a tenth embodiment of the present invention. The tenth embodiment differs from the first embodiment in that the communicator unit 2 further comprises a reverse analyzer 31. The reverse analyzer 31 inputs a reverse gear signal obtained from a gear sensor which detects the reverse gear position of a transmission of the automotive vehicle 100. The reverse analyzer 31 outputs reverse gear information based on the reverse gear signal.

The controller 23 causes the memory 22 to store the reverse gear information thus obtained during a predetermined past time (which is arbitrarily determined). When the radio communicator 21 performs the emergency report processing in response to the traffic accident or the like, the controller 23 generates the emergency report information including the reverse gear information stored in the memory 22. The radio communicator 21 transmits the reverse gear information to the emergency center 200. Thus, the personnel in the emergency center 200 can promptly grasp the aspect of the traffic accident including the traveling direction of automotive vehicle 100.

Meanwhile, the tenth embodiment allows the rescue worker or anyone else arriving at the site of traffic accident to output the data retroactively stored in the memory 22 to check whether the transmission was set to the reverse gear position at the time the automotive vehicle 100 was involved in the traffic accident. When the data switch 41 is depressed by the rescue worker or anyone else, the controller 23 reads the data from the memory 22 and displays the readout data on the LCD unit 42.

Namely, the tenth embodiment provides a Mayday system equipment comprising the communicator unit (2) including a reverse analyzer (31) for detecting a reverse gear position of a transmission of the automotive vehicle (100), a memory (22) for storing the data obtained by the reverse analyzer (31), and means (21, 22, 23) for performing emergency report processing to report the traveling direction of the automotive vehicle in an emergency situation. The information transmitted to the emergency center (200) through the emergency report processing includes the setting of the reverse gear position in the transmission of the automotive vehicle (100). The communicator unit (2) outputs the data stored in the memory (22) in response to a request signal to check the traveling direction of the automotive vehicle (100).

Eleventh Embodiment

Figure 11:
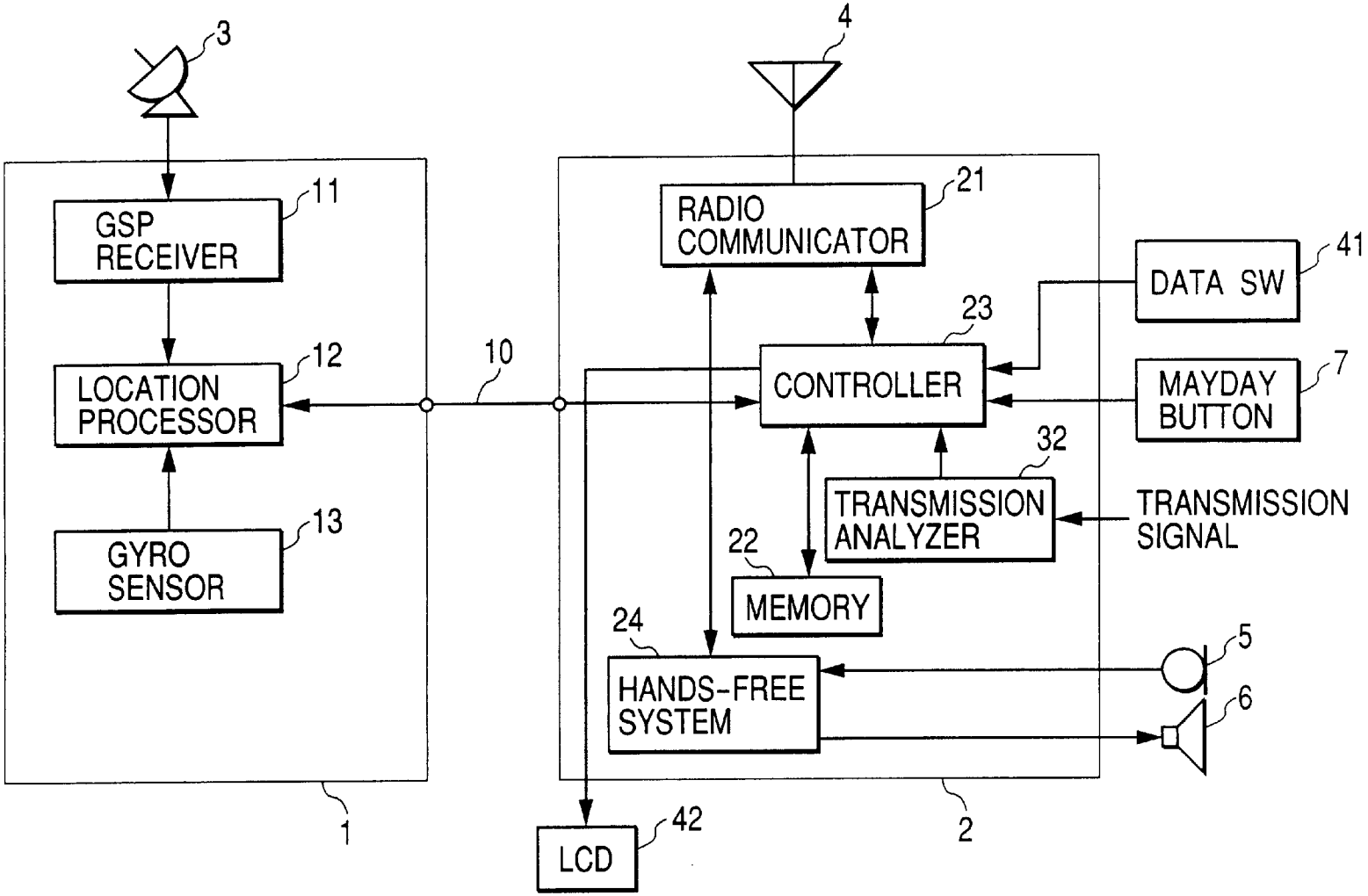
FIG. 11 is a circuit diagram showing the schematic arrangement of a Mayday system equipment in accordance with an eleventh embodiment of the present invention.

FIG. 11 is a circuit diagram showing the schematic arrangement of the Mayday system equipment in accordance with an eleventh embodiment of the present invention. The eleventh embodiment differs from the first embodiment in that the communicator unit 2 further comprises a transmission analyzer 32. The transmission analyzer 32 inputs a transmission signal (e.g., a shift lever position signal or a gear position signal) obtained from a sensor which detects the shift lever position or the gear position of the transmission of automotive vehicle 100. The transmission analyzer 32 outputs transmission information based on the transmission signal (e.g., the shift lever position signal or the gear position signal).

The controller 23 causes the memory 22 to store the transmission information thus obtained during a predetermined past time (which is arbitrarily determined). When the radio communicator 21 performs the emergency report processing in response to the traffic accident or the like, the controller 23 generates the emergency report information including the transmission information stored in the memory 22. The radio communicator 21 transmits the transmission information to the emergency center 200. Thus, the personnel in the emergency center 200 can promptly grasp the aspect of the traffic accident including the shift or gear position of the transmission of automotive vehicle 100.

Meanwhile, the eleventh embodiment allows the rescue worker or anyone else arriving at the site of traffic accident to output the data retroactively stored in the memory 22 to check the shift or gear position of the transmission being set at the time the automotive vehicle 100 was involved in the traffic accident. When the data switch 41 is depressed by the rescue worker or anyone else, the controller 23 reads the data from the memory 22 and displays the readout data on the LCD unit 42.This is helpful to roughly estimate as to whether the automotive vehicle 100 was traveling at high speeds (=at a higher gear position) or at lower speeds (=at a lower gear position).

Namely, the eleventh embodiment provides a Mayday system equipment comprising the communicator unit (2) including a transmission analyzer (32) for detecting a shift lever position or a gear position of a transmission of the automotive vehicle (100), a memory (22) for storing the data obtained by the transmission analyzer (32), and means (21, 22, 23) for performing emergency report processing to report the transmission condition of the automotive vehicle in an emergency situation. The information transmitted to the emergency center (200) through the emergency report processing includes the shift lever position or the gear position of the transmission of the automotive vehicle (100). The communicator unit (2) outputs the data stored in the memory (22) in response to a request signal to check the shift lever position or the gear position of the transmission of the automotive vehicle (100).

Twelfth Embodiment

Figure 12:
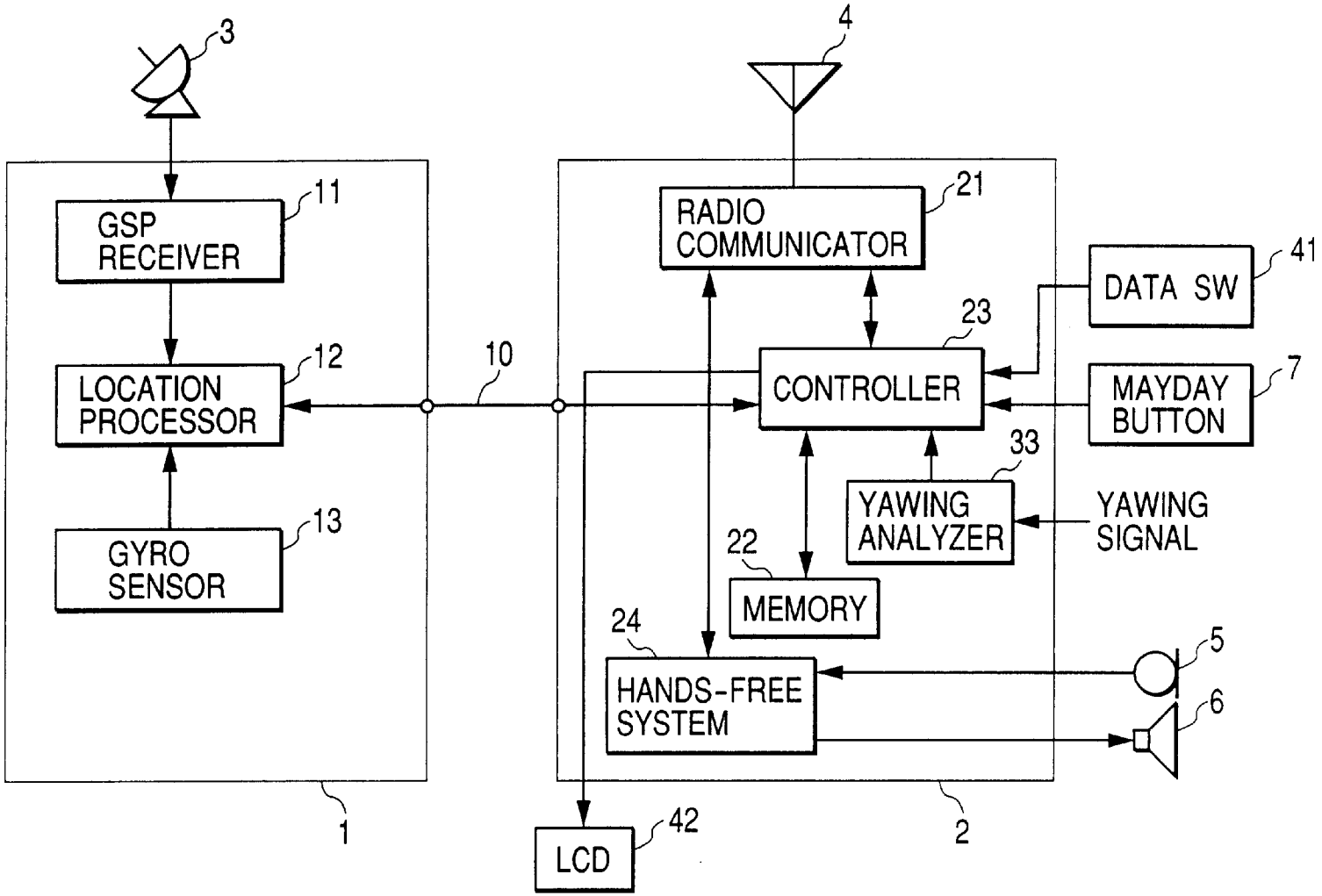
FIG. 12 is a circuit diagram showing the schematic arrangement of a Mayday system equipment in accordance with a twelfth embodiment of the present invention.

FIG. 12 is a circuit diagram showing the schematic arrangement of the Mayday system equipment in accordance with a twelfth embodiment of the present invention. The twelfth embodiment differs from the first embodiment in that the communicator unit 2 further comprises a yawing analyzer 33. The yawing analyzer 33 inputs a yawing signal obtained from a sensor which detects the yawing (i.e., lateral acceleration) of the automotive vehicle 100. The yawing analyzer 33 outputs yawing information based on the yawing signal.

The controller 23 causes the memory 22 to store the yawing information thus obtained during a predetermined past time (which is arbitrarily determined). When the radio communicator 21 performs the emergency report processing in response to the traffic accident or the like, the controller 23 generates the emergency report information including the yawing information stored in the memory 22. The radio communicator 21 transmits the yawing information to the emergency center 200. Thus, the personnel in the emergency center 200 can promptly grasp the aspect of the traffic accident including the yawing behavior of the automotive vehicle 100.

Meanwhile, the twelfth embodiment allows the rescue worker or anyone else arriving at the site of traffic accident to output the data retroactively stored in the memory 22 to check the yawing behavior of the automotive vehicle 100 at the time the automotive vehicle 100 was involved in the traffic accident. When the data switch 41 is depressed by the rescue worker or anyone else, the controller 23 reads the data from the memory 22 and displays the readout data on the LCD unit 42.This is helpful to roughly estimate as to whether the automotive vehicle 100 was traveling in a meandering or zigzag manner due to doze or drinking of the driver.

Data/Signal Transmission Between Locator and Communicator

In the above embodiments, the data/signal transmission between the locator unit 1 and the communicator 2 is performed via the connecting cable 10. The following signals are available for such data/signal transmission between the locator unit 1 and the communicator 2 via the connecting cable 10:

asynchronous serial signal;

synchronous serial signal used in a clock synchronous transmission performed in response to a clock signal, a frame signal or the like;

LAN signal used in an IE-BUS system, an ARCNET system or the like which establishes a communications network for a plurality of devices connected by cable; and bus communication signal used in the parallel signal-based data transmission processing for a plurality of devices connected by cable.

Furthermore, if it is desirable to omit the cable 10, the following signals are available for wireless data/signal transmission between the locator unit 1 and the communicator 2 (refer to FIG. 14):

infrared ray signal requiring no cable; and radio communication signal requiring no cable.

Possible Modifications

Figure 15:
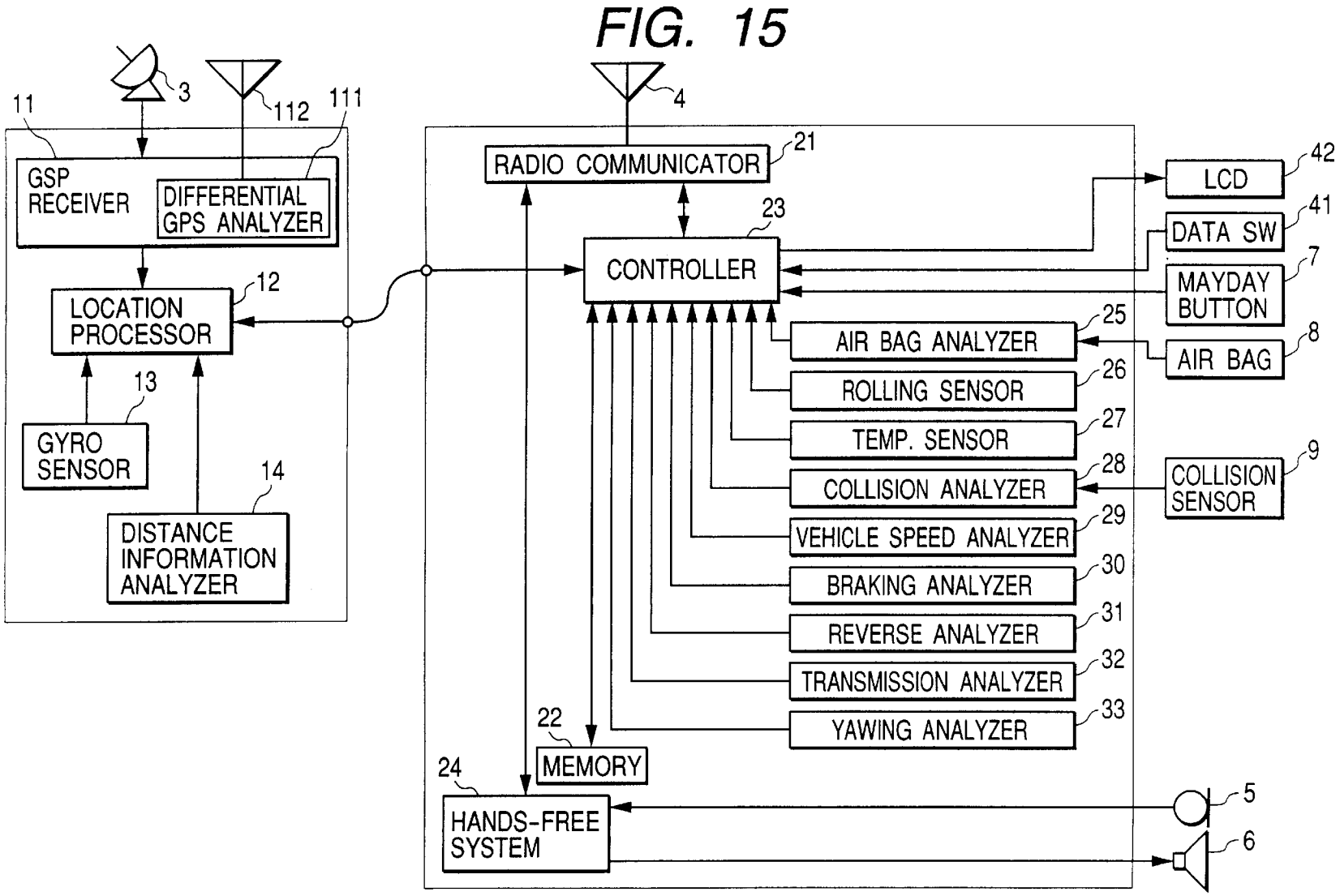
FIG. 15 is a circuit diagram showing the schematic arrangement of a Mayday system equipment incorporating all of the first to twelfth embodiments of the present invention.

It is needless to say that some or all of the above-described embodiments can be combined each other so that the Mayday system equipment 101 of the present invention can operate with multiple functions as shown in FIG. 15.

Moreover, it is possible to constitute the locator unit 1 and the communicator unit 2 as computer-based devices. In this case, some of the above-described components included in the locator unit 1 and the communicator unit 2 are functionally replacable by the computer.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A Mayday system equipment installable on an automotive vehicle, said Mayday system equipment comprising:

a locator unit for producing vehicle locative information;

analyzing means for detecting vehicle specific conditions and outputting corresponding data;

storage means for storing said data;

means for performing emergency report processing in response to said output data;

display means integrated in said vehicle and responsive to a request signal, wherein said storage means outputs said stored data and said display means displays said data; and a communicator unit in communication with but separately arranged from said locator unit to form a unit independent from the locator unit for producing emergency report information including said vehicle locative information produced by said locator unit, and for transmitting said emergency report information to an emergency center.

2. The Mayday system equipment in accordance with claim 1, wherein data/signal transmission between said locator unit and said communicator unit is performed via a cable.

3. The Mayday system equipment in accordance with claim 1, wherein data/signal transmission between said locator unit and said communicator unit is performed by wireless.

4. The Mayday system equipment in accordance with claim 1, wherein said locator unit includes a GPS (i.e., Global Positioning System) receiver which performs communications with a satellite to obtain GPS information representing the present position of said automotive vehicle.

5. The Mayday system equipment in accordance with claim 1, wherein said locator unit includes a gyro sensor which produces angular information representing the traveling direction of said automotive vehicle.

6. The Mayday system equipment in accordance with claim 1, wherein said locator unit includes a distance information analyzer which obtains distance information representing a traveling distance of said automotive vehicle.

7. The Mayday system equipment in accordance with claim 1, wherein said communicator unit includes means for performing emergency report processing in response to a signal of a Mayday signal generating means.

8. The Mayday system equipment in accordance with claim 1, wherein said communicator unit includes a hands-free system which allows a user to communicate with said emergency center without using a handset.

9. The Mayday system equipment in accordance with any claim 1, wherein said communicator unit includes an air bag analyzer for detecting activation of an air bag, a memory for storing the data obtained by said air bag analyzer, and means for performing emergency report processing in response to a signal of said air bag analyzer when said air bag is activated.

10. The Mayday system equipment in accordance with claim 9, wherein information transmitted to said emergency center through said emergency report processing includes the activation of said air bag.

11. The Mayday system equipment in accordance with claim 9, wherein said communicator unit outputs the data stored in said memory in response to a request signal to check the activation of said air bag.

12. The Mayday system equipment in accordance with claim 1, wherein said communicator unit includes a rolling sensor for detecting rolling of said automotive vehicle, a memory for storing the data obtained by said rolling sensor, and means for performing emergency report processing in response to a signal of said rolling sensor when said automotive vehicle has rolled.

13. The Mayday system equipment in accordance with claim 12, wherein information transmitted to said emergency center through said emergency report processing includes the rolling of said automotive vehicle.

14. The Mayday system equipment in accordance with claim 12, wherein said communicator unit outputs the data stored in said memory in response to a request signal to check the occurrence of rolling of said automotive vehicle.

15. The Mayday system equipment in accordance with claim 1, wherein said communicator unit includes a collision analyzer for detecting collision of said automotive vehicle, a memory for storing the data obtained by said collision analyzer, and means for performing emergency report processing in response to a signal of said collision analyzer when said automotive vehicle is involved in a traffic accident.

16. The Mayday system equipment in accordance with claim 15, wherein information transmitted to said emergency center through said emergency report processing includes the collision of said automotive vehicle.

17. The Mayday system equipment in accordance with claim 15, wherein said communicator unit outputs the data stored in said memory in response to a request signal to check the occurrence of collision of said automotive vehicle.

18. The Mayday system equipment in accordance with claim 1, wherein said communicator unit includes a vehicle speed analyzer for detecting a traveling speed of said automotive vehicle, and a memory for storing the data obtained by said vehicle speed analyzer.

19. The Mayday system equipment in accordance with claim 18, wherein emergency report processing is performed to report the traveling condition of said automotive vehicle in an emergency situation, and the information transmitted to said emergency center through said emergency report processing includes the traveling speed of said automotive vehicle.

20. The Mayday system equipment in accordance with claim 18, wherein said communicator unit outputs the data stored in said memory in response to a request signal to check the recorded traveling speed of said automotive vehicle.

21. The Mayday system equipment in accordance with claim 1, wherein said communicator unit includes a yawing analyzer for detecting a yawing behavior of said automotive vehicle, and a memory for storing the data obtained by said yawing analyzer.

22. The Mayday system equipment in accordance with claim 21, wherein emergency report processing is performed to report the traveling condition of said automotive vehicle in an emergency situation, and the information transmitted to said emergency center through said emergency report processing includes the yawing of said automotive vehicle.

23. The Mayday system equipment in accordance with claim 21, wherein said communicator unit outputs the data stored in said memory in response to a request signal to check the occurrence of yawing behavior of said automotive vehicle.

24. A Mayday system comprising:

a Mayday system equipment installed on an automotive vehicle;

a GPS satellite providing GPS information for said automotive vehicle; and an emergency center, characterized in that said Mayday system equipment comprises:

a locator unit for producing vehicle locative information based on communications with said GPS satellite, analyzing means for detecting vehicle specific conditions and outputting corresponding data, storage means for storing said data, means for performing emergency report processing in response to said output data;

display means integrated in said vehicle and responsive to a request signal, wherein said storage means outputs said stored data and said display means displays said data, and a communicator unit in communication with but separately arranged from said locator unit to form a unit independent from the locator unit for producing emergency report information including said vehicle locative information produced by said locator unit;

wherein said emergency report information is transmitted from said communicator unit to said emergency center.

25. A Mayday system equipment installable on an automotive vehicle, said Mayday system equipment comprising:

a locator unit for producing vehicle locative information;

analyzing means for detecting vehicle specific conditions and outputting corresponding data;

storage means for storing said data;

means for performing emergency report processing in response to said output data;

display means integrated in said vehicle and responsive to a request signal, wherein said storage means outputs said stored data and said display means displays said data; and a communicator unit in communication with but detachably arranged from said locator unit for producing emergency report information including said vehicle locative information produced by said locator unit, and for transmitting said emergency report information to an emergency center.

26. A Mayday system comprising:

a Mayday system equipment installed on an automotive vehicle;

a GPS satellite providing GPS information for said automotive vehicle; and an emergency center, characterized in that said Mayday system equipment comprises;

a locator unit for producing vehicle locative information based on communications with said GPS satellite, analyzing means for detecting vehicle specific conditions and outputting corresponding data, storage means for storing said data, means for performing emergency report processing in response to said output data;

display means integrated in said vehicle and responsive to a request signal, wherein said storage means outputs said stored data and said display means displays said data, and a communicator unit in communication with but detachably arranged from said locator unit for producing emergency report information including said vehicle locative information produced by said locator unit, said emergency report information is transmitted from said communicator unit to said emergency center.

* * * * *